US007409783B2

(12) United States Patent
Chang

(10) Patent No.: US 7,409,783 B2
(45) Date of Patent: Aug. 12, 2008

(54) SPIKE

(75) Inventor: Fu-Chuan Chang, Taipei (TW)

(73) Assignee: Vanbestco Ltd., Taipei (TW)

( * ) Notice: Subject to any disclaimer, the term of this patent is extended or adjusted under 35 U.S.C. 154(b) by 330 days.

(21) Appl. No.: 11/271,822

(22) Filed: Nov. 14, 2005

(65) Prior Publication Data

US 2007/0107262 A1 May 17, 2007

(51) Int. Cl.
*A43C 15/02* (2006.01)

(52) U.S. Cl. ..... 36/59 R; 36/127; 36/129

(58) Field of Classification Search ..... 36/127, 36/134, 67, 129, 126, 67 A, 67 B, 67 C, 102, 36/59 R See application file for complete search history.

(56) References Cited

U.S. PATENT DOCUMENTS 2,061,962 A * 11/1936 Gabriele ..... 36/59 R
2,192,150 A * 2/1940 Pierce et al. ..... 36/134
2,315,874 A * 4/1943 Sabel et al. ..... 36/127
3,237,323 A * 3/1966 MacNeill ..... 36/59 R
3,597,863 A * 8/1971 Austin et al. ..... 36/59 R
3,667,141 A * 6/1972 White ..... 36/67 B
4,240,215 A * 12/1980 Broussard ..... 36/67 D
4,715,133 A * 12/1987 Hartjes et al. ..... 36/127
6,029,377 A * 2/2000 Niikura et al. ..... 36/67 R
6,338,208 B1 * 1/2002 Waterbury ..... 36/134
6,775,931 B2 * 8/2004 Hokkirigawa et al. ..... 36/134

FOREIGN PATENT DOCUMENTS

DE 4137350 A1 * 5/1993

* cited by examiner

*Primary Examiner*—Ted Kavanaugh
(74) *Attorney, Agent, or Firm*—Troxell Law Office, PLLC

(57) ABSTRACT

This invention relates to an improved spike installed in a sole of a shoe and consists of a receptacle having a base and several connecting seats integrated around the edge of the base in one piece flexibly moving in proportion to the base. Several spikes are installed unto individual connecting seats extruding the sole. Accordingly, each connecting seat and partial spikes are wrapped up by the flexible sole. When spikes receive an external force causing connecting seats to deviate slightly and simultaneously, the elasticity of the sole material and elastic recovery of each connecting seat are used ingeniously to create proper grip.

8 Claims, 4 Drawing Sheets

SPIKE

BACKGROUND OF THE INVENTION

1. Field of the Invention

This invention relates to footwear. More particularly, the invention is directed to improve spikes.

2. Description of the Related Art

Spikes are commonly installed on the bottom of footwear for skidproof and grip effects when shoes wearers stand or walk on grass or places with soft soil. Hence, footwear with spikes is mostly designed for exercise doers like track and field and golfing, etc.

Spikes are usually divided into two types. One is single column spikes and the other is disc-shaped spikes. Though several spikes are arranged on the bottoms of shoes for the first type; however, not many spikes are installed on the bottoms due to cost and design. Consequently, this type has single-point grip that is not sufficient. Furthermore, the reacting force is sent back to the feet of the wearers stamping on the ground, which causes discomfort for the wearers. A number of spikes are installed to enhance the skidproof effect for the second type. Nevertheless, the design of a rigid disc with many spikes is only effective in slip resistance without any real grip.

SUMMARY OF THE INVENTION

The main purpose of this invention is to provide spikes that may solve the aforementioned problems. Each spike may deviate flexibly to create excellent skidproof and grip effects.

Accordingly, to achieve the aforementioned purpose, this invention relates to an improved spike with a receptacle installed in a sole of a shoe and a base and several connecting seats integrated around the edge of the base in one piece flexibly moving in proportion to the base. Several spikes are installed unto individual connecting seats extruding the sole.

BRIEF DESCRIPTION OF THE DRAWINGS

A description of the content and the technology of this invention along with drawings is made in detail as follows.

DETAILED DESCRIPTION OF THE INVENTION

Figure 1:
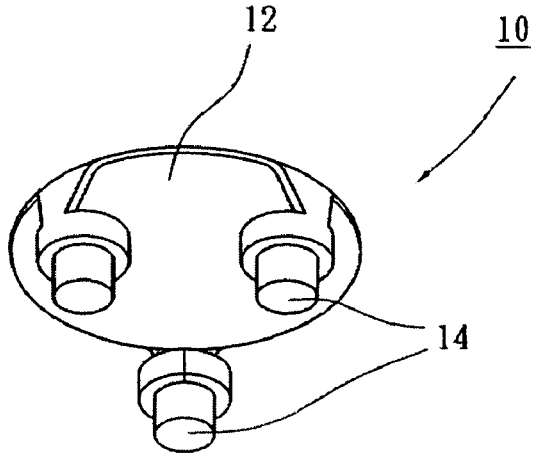
FIG. 1 is an exploded view of a first preferred embodiment of the present invention.
Figure 2:
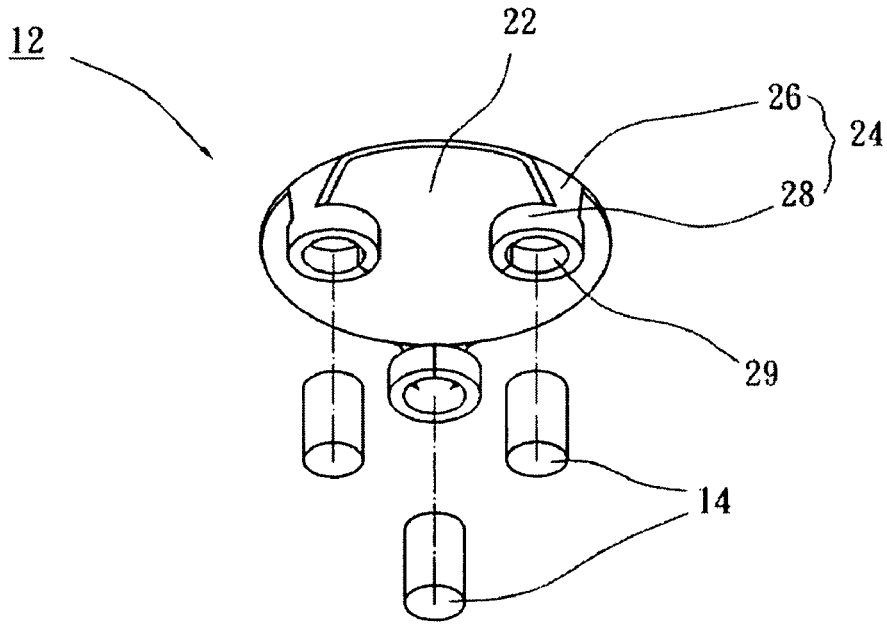
FIG. 2 is an exploded view in parts of the first preferred embodiment of the present invention.
Figure 3:
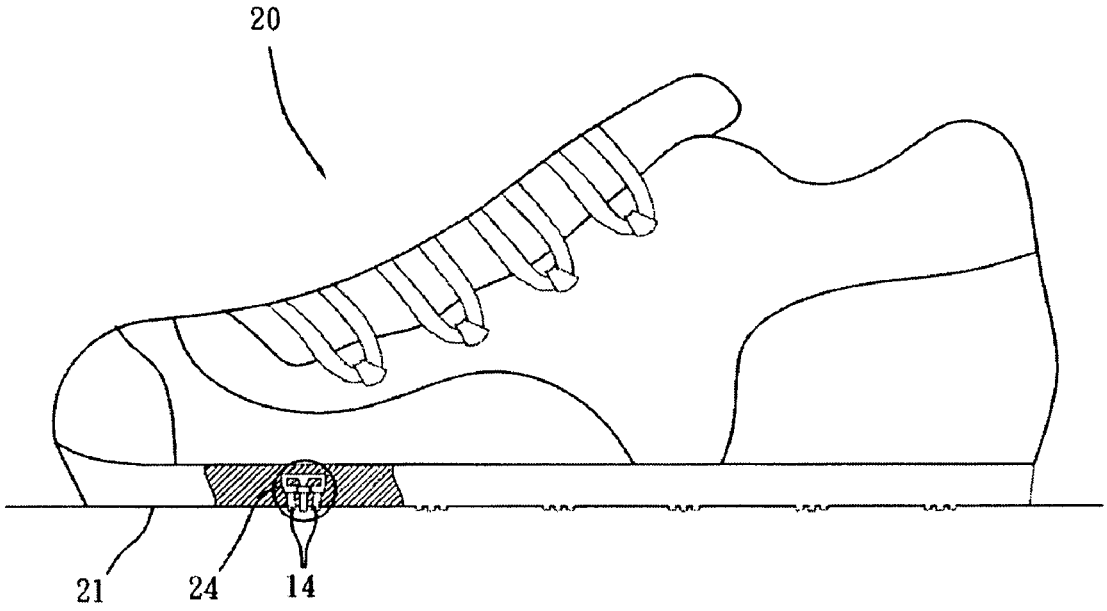
FIG. 3 is a view of the first preferred embodiment of the present invention installed on the sole showing spikes inserting to the ground.
Figure 3A:
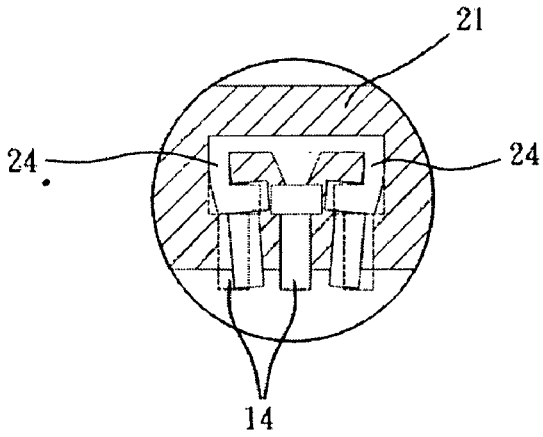
FIG. 3A is an amplification display view in parts of FIG. 3.

First, refer to FIGS. 1 thru 3. Spikes 10 in a preferred embodiment of the present invention are installed unto a flexible sole 21 of a shoe 20 and constituted by one receptacle 12 and several tacks 14.

The receptacle 12 is made of flexural metal material and has a base 22 and three connecting seats 24 formed by bending the piece extruding the outer edge of the base 22 for slight flexible deviation relative to the base 22. One foundation 26 is bent and formed on the edge of the base 22. One stand 28 is connected to the foundation 26 and bent into a circle for the hole 29.

Each tack 14 is made of metal material harder than that of the receptacle 12 and inserted into corresponding hole 29 respectively.

Thus, the receptacle 12 is situated in the sole 21 and the end of each tack 14 extrudes the sole 21 at a proper length. Consequently, every connecting seat 24 and tack 14 are enclosed by the flexible material of the sole 21 The flexibility of the sole 21 and slight flexible deviation of the connecting seat 24 relative to the base 22 are ingeniously designed for a proper grip for each tack 14.

Figure 4:
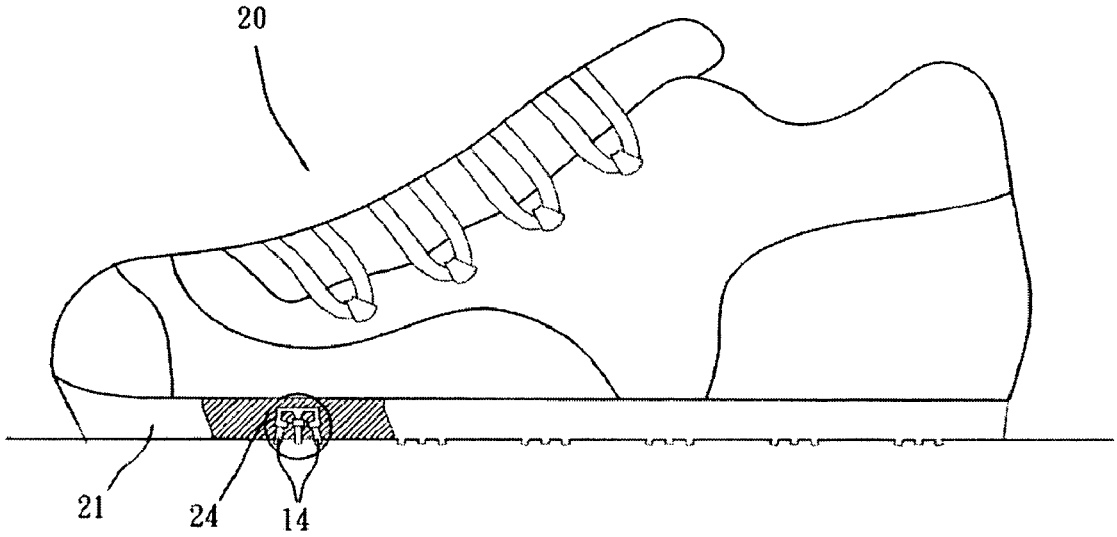
FIG. 4 is another view of the first preferred embodiment of the present invention installed on the sole showing spikes inserting to the ground.
Figure 4A:
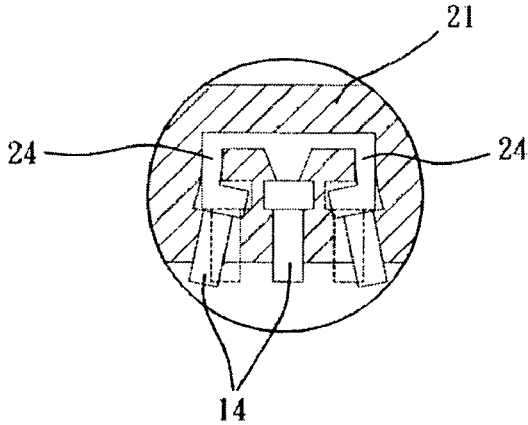
FIG. 4A is an amplification display view in parts of FIG. 4.

As the angle of the feet and the ground changes slightly while walking, the angle formed by each spike 10 installed on the bottom of the shoe 20 and the ground also varies as shown in FIG. 3. When each tack 14 draws in slightly, every tack 14 on the sole 21 will be compressed resulting in a rebounding force that will coordinate the slight expanding elastic recovery of each connecting seat 24 in proportion to the base 22. Consequently, the expanding strength of each tack 14 can be increased and the skidproof and gripping effects of every tack 14 can be enhanced. On the contrary, when each tack 14 expands outwardly a little bit as shown in FIG. 4, every tack 14 outside the sole 21 will be pressed resulting in a rebounding force that will draw the tack 14 in and coordinate the slight drawn-in elastic recovery of each connecting seat 24 relative to the base 22. In this way, the drawn-in strength of each tack 14 will be motivated and the skidproof and gripping effects can be enhanced.

Figure 5:
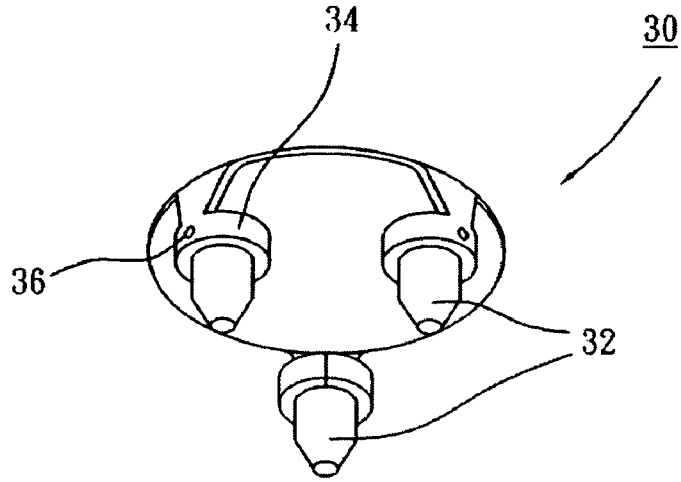
FIG. 5 is an exploded diagram of the second preferred embodiment of the present invention.

Refer to the spike 30 in FIG. 5 for another preferred embodiment of the present invention. The structure is identical to that of the spike 10 in general. The differences are the cone-shaped end of each tack 32 and a dent 36 on the outside of each connecting seat 34 corresponding to the tack 32 to prevent each tack 32 from getting loose from the connecting seat 34 or being squeezing into the inner end of the connecting seat 34 because of an external force. Therefore, each tack 32 can be clipped tightly and the excellent skidproof and gripping effects disclosed above will be achieved.

Figure 6:
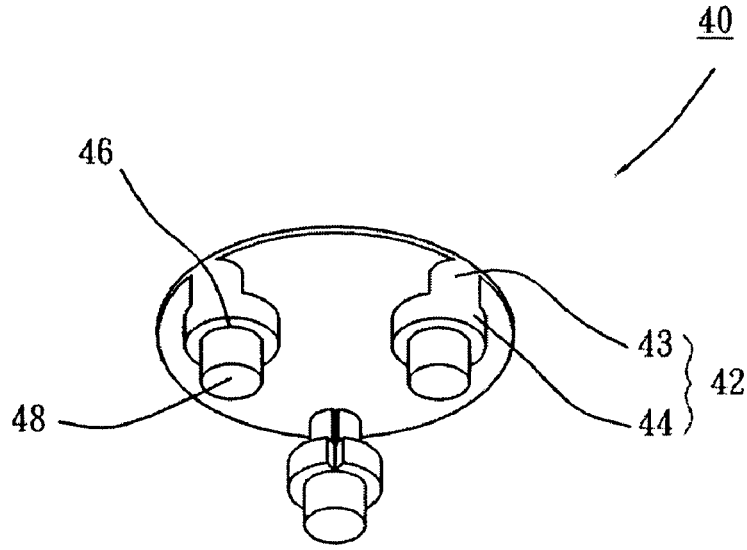
FIG. 6 is an exploded diagram of the third preferred embodiment of the present invention.

Refer to the spike 40 in FIG. 6 for still another preferred embodiment of the present invention. Both sides of the foundation 43 of each connecting seat 42 are bent relatively and corresponding to the hole 46 of the stand 44 so that the inner end of each tack 48 can be propped up against the end surface of the foundation 43. As a result, each tack 48 won't squeeze towards the inner end of the connecting seat 42 affecting gripping effect.

Accordingly, the spike of this invention works with the wrapped connecting seat and the sole flexible material of the tack perfectly via each connecting seat deviating opportunely and flexibly. A better grip is generated by changing elastic recovery appropriately no matter what angle of deviation is when each tack contacts the ground. This invention indeed has more excellent skidproof effect compared with other commonly known spikes.

What is claimed is:

1. A spike assembly installed in a flexible sole of a shoe and comprising:

a receptacle having a base and a plurality of connecting seats formed around an edge of the base, the plurality of connecting seats the receptacle as formed as one piece, the plurality of connecting seats are flexible relative to the base; and a plurality of tacks, one of the plurality of tacks is inserted into each of the plurality of connecting seats extending outwardly from the flexible sole, a predetermined portion of the plurality of connecting seats and the plurality of tacks are inserted into the flexible sole, wherein, when an external force is applied to the plurality of tacks, the plurality of connecting seats deviating simultaneously.

2. The spike assembly according to claim 1, wherein the receptacle is made of metal material.

3. The spike assembly according to claim 1, wherein each of the plurality of connecting seats has one stand with a hole into which one end of a corresponding one of the plurality of tacks is inserted.

4. The spike assembly according to claim 3, wherein a section of each stand is shaped like a circle to form a hole.

5. The spike assembly according to claim 4, wherein each stand has one dent corresponding one tack of the plurality of tacks to pack the tack.

6. The spike assembly according to claim 4, wherein each of the plurality of connecting seats has one foundation bent around the edge of the base, and every stand is connected to an outer end of the foundation.

7. The spike assembly according to claim 6, wherein two sides of each foundation are relative to the hole on the stand, each tack is positioned against a end surface of the foundation.

8. The spike assembly according to claim 1, wherein each of the plurality of tacks is made of metal material.

* * * * *